United States Patent [19]

Feather et al.

[11] Patent Number: 4,864,266

[45] Date of Patent: Sep. 5, 1989

[54] HIGH-VOLTAGE WINDING FOR CORE-FORM POWER TRANSFORMERS

[75] Inventors: Landis E. Feather, Hermitage; Paul W. Martincic, Hermitage Township; Richard D. Holm, Penn Hills Township, all of Pa.; Richard E. Thompson, Muncie, Ind.

[73] Assignee: Electric Power Research Institute, Inc., Palo Alto, Calif.

[21] Appl. No.: 277,554

[22] Filed: Nov. 29, 1988

Related U.S. Application Data

[63] Continuation-in-part of Ser. No. 188,239, Apr. 29, 1988.

[51] Int. Cl.[4] ..... H01F 21/12; H01F 27/18

[52] U.S. Cl. ..... 336/150; 174/114 R; 174/119 R; 336/186; 336/187; 336/223

[58] Field of Search ..... 174/114 R, 114 S, 119 R; 336/69, 70, 223, 186, 187, 205, 206, 150, 183

[56] References Cited

U.S. PATENT DOCUMENTS

| | | | |
|---|---|---|---|
| 2,978,530 | 4/1961 | Braeckman | 174/119 R |
| 3,237,136 | 2/1966 | Ford | 336/206 X |
| 3,312,775 | 4/1967 | Lambert . | |
| 3,466,584 | 9/1969 | Kashima | 336/70 |
| 3,467,931 | 9/1969 | Dutton | 336/180 |
| 3,579,084 | 5/1971 | Moyer | 336/69 |
| 3,647,932 | 3/1972 | Heller et al. | 336/187 |
| 3,688,233 | 8/1972 | Moore et al. | 336/187 X |
| 3,925,743 | 12/1975 | Van Vice | 336/70 |
| 4,013,987 | 3/1977 | Foster | 336/206 |
| 4,239,077 | 12/1980 | Dixon et al. . | |
| 4,431,860 | 2/1984 | Perco et al. | 336/187 X |
| 4,439,256 | 5/1984 | Meserue | 156/50 |
| 4,473,716 | 9/1984 | Jesseman | 174/117 F |
| 4,489,298 | 12/1984 | Hall | 336/223 X |
| 4,546,210 | 10/1985 | Akiba et al. | 174/114 R |
| 4,549,042 | 10/1985 | Akiba et al. | 336/223 |
| 4,554,523 | 11/1985 | Miki et al. | 336/70 |
| 4,554,730 | 11/1985 | Westarvelt et al. | 336/205 X |

FOREIGN PATENT DOCUMENTS 580524 8/1958 Italy .

*Primary Examiner*—Thomas J. Kozma
*Attorney, Agent, or Firm*—Flehr, Hohbach, Test, Albritton & Herbert

[57] ABSTRACT

A high-voltage winding for core-form power transformers is disclosed that uses two different conductor configurations within a single coil to minimize eddy current losses. The winding includes a first elongated conductor bundle formed from a plurality of thin enamel coated conductor ribbons arranged in side by side relation. A plurality of second elongated conductor bundles are each formed from at least one bundle section having a multiplicity of elongated insulated conductor strands arranged in side by side relation. Each of the conductor strands is less than 40 mils thick. The coil includes a top end section, a body section and a bottom end section. The body section is spirally wound with the first conductor bundle. The top and bottom end sections are wound with the second conductor bundles. In windings that include tap connectors, the tap section is also wound with one of the second conductor bundles.

19 Claims, 3 Drawing Sheets

HIGH-VOLTAGE WINDING FOR CORE-FORM POWER TRANSFORMERS

BACKGROUND OF THE INVENTION

This application is a Continuation-in-Part of copending application Ser. No. 188,239 filed Apr. 29, 1988, which is incorporated herein by reference.

The present invention relates generally to an improved construction and winding method for a core-form power transformer. More particularly, two different specific conductor configurations are provided in a single coil to minimize eddy current losses.

Modern transformer windings are fabricated using a wide variety of methods. In high power applications, a rectangular shaped conductor strip is generally spirally wound about a core to form a coil. Often, the conductive strip itself is composed of a plurality of strands arranged side by side in a roll. The strands themselves may be rectangular to both increase strength, and to provide a more compact transformer.

There are several factors that influence transformer efficiency. Two of the most notable losses are caused by eddy currents and circulating currents within the windings. It has been realized that eddy currents are dependent to a large extent on the dimensions of the conductors. Specifically, eddy current losses may be significantly reduced by reducing the dimensions of the conducting strands. Experiments have shown that conductor bundles comprised of a large number of finely stranded conductors have several advantages over prior conductor constructions, particularly in reducing eddy currents in portions of the transformer that are subject to large eddy current losses.

Conventional core-form coils have two distinct magnetic flux situations about the length of the coil. Specifically, a substantially uniform axial field exists along most of the vertical height of the coil. In contrast, the top and bottom ends of the coil are subject to divergent fields. In core-form coils that utilize tap connectors for a deenergized tap changer (DTC), divergent fields are found about the tap connectors as well. Eddy current losses are particularly prevalent in regions that have divergent fields.

SUMMARY OF THE INVENTION

Therefore, it is a primary objective of the present invention to provide an improved high-voltage winding for core-form power transformers that utilize finely stranded conductors to improve transformer efficiency.

A more specific objective is to provide an improved high-voltage winding for core-form.

To achieve the foregoing and other objects and in accordance with the purpose of the present invention, a winding for a core-form induction transformer is disclosed having distinct body and end sections. The body section of the transformer is wound with a first elongated conductor bundle having a plurality of insulated conductor ribbons arranged in a side by side relation. The conductor bundle is spirally wound in a multiplicity of turns to form the body portion of the coil. The end sections of the transformer are each formed from a second elongated conductor bundle having at least one bundle section comprised of a multiplicity of elongated conductor strands arranged in side by side relation. Each of the conductor strands has a substantially rectangular cross section with a pair of spaced apart substantially parallel contact surfaces that are joined by a minor axis. The thickness of each conductor strand along its minor axis is less than approximately 40 mils and the multiplicity of the conductor strands are placed side by side such that the respective contact surfaces abut. The second conductor bundles, like the first, are spirally wound in a multiplicity of turns to form the end portions of the coil.

In embodiments of the transformer that include tap connectors, the winding preferably also includes a tap section that is wound about the tap connectors with a conductor bundle having at least one bundle section formed from a multiplicity of elongated tap connector strands arranged similarly to the end conductor strands discussed above.

In a preferred embodiment, the end and tap conductor strands are in the range of 60 to 90 mils wide and have a thickness in the range of 20 to 40 mils and the conductor ribbons and strands are insulated with a material such as enamel.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying drawings in which:

DETAILED DESCRIPTION OF ILLUSTRATIVE EMBODIMENTS

Figure 1:
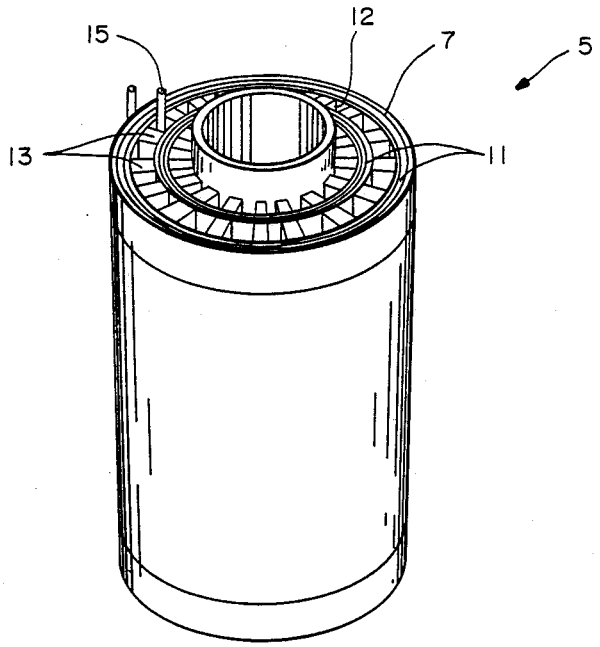
(PRIOR ART) FIG.—1
FIG. 1 is a perspective view of a conventional core-form transformer.

As illustrated in the drawings, the present invention comprises a novel high voltage core-form transformer coil that uses two different conductor configurations within the same coil. Referring initially to FIG. 1, a typical coil winding for use in core-form transformers is shown for illustrative purposes. It will be appreciated that any other coil construction would be equally operative for the purpose of this disclosure. The winding 5 is comprised of an elongated conductor bundle 7 spirally wound about a winding tube 9 to form a plurality of layers or turns. The turns may be separated into a plurality of groups 11 that are separated by cooling ducts 12 that facilitate cooling the winding. Axially extending spacing members 13 are provided to maintain the dimensions of the cooling ducts. One or more taps 15 having tap connectors 17 may be provided to maintain the concentricity of the winding.

Two magnetic flux situations exist within core-form coils. First, there is a substantially uniform axial field that extends most of the vertical height of the coil. The section of the coil having the uniform axial field will be referred to herein as the body section 20 of the winding. Divergent fields occur at the opposite end sections 22 and 24 of the coil. Additionally, a divergent field will occur adjacent to that scope tap connectors 17 in coils which incorporate such structures. The region of the winding adjacent to that scope a tap connector 17 that induces a divergent field is referred to herein as the tap section 26.

Figure 3:
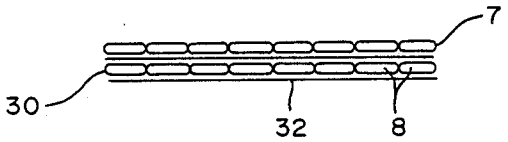
FIG. 3 is a diagrammatic cross sectional view through two turns of a body section conductor bundle as seen in FIG. 2.
Figure 2:
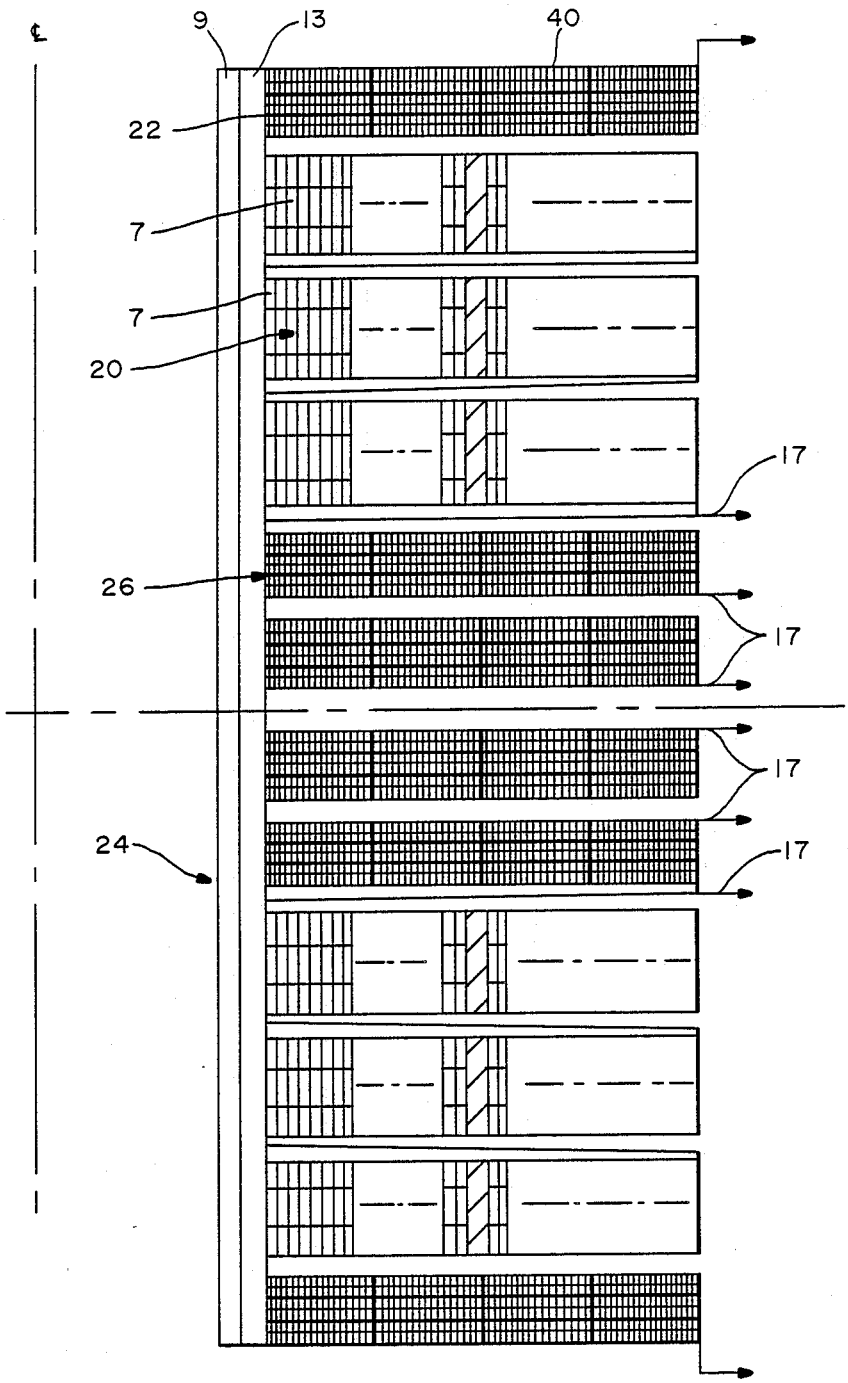
FIG. 2 is a vertical sectional view of a core form transformer wound in accordance with the present invention.

Reference is next made to FIG. 2, which illustrates the embodiment of the invention chosen for the purposes of illustration. Within the body section 20 of the transformer, where there is a uniform axial field, the eddy current losses are a function of the radial dimensions of the individual ribbons that form the conductor bundle. Therefore, as can be seen in FIGS. 2 and 3, within the body section, the conductor bundle 7 is formed of several wide rectangular insulated conductor ribbons 8. The conductor bundle, in effect forms a turn and the actual width of the conductor bundle, as well as the actual dimensions of the various conductor ribbons are selected to provide a turn having the area and total width dictated by a particular coil design. By way of example, in many high voltage transformer applications, a winding width in the range of 2 to 4 inches would be appropriate.

The large width of the conductor bundles 7 insures that the series capacitance of the coil will be very high and that the impulse voltage distribution will be essentially uniform. Thus, the conductor bundle insulation can be much thinner than that provided on conventional continuous coils. A heavy enamel coating 30 on the conductor ribbons 8 provides adequate turn-to-turn insulation. However, to increase the mechanical strength of the coil 5, a sheet of adhesive coated paper 32 having the same width as the conductor bundle 7, is wound in between turns. By way of example, the adhesive paper 32 may take the form of 3–7 mil thick paper coated on both sides with a heat-curing adhesive. Heavy enameled coated wires having dimensions in the range of 30–96 mils by 280–580 mils would be appropriate to form the conductor ribbons 8. Appropriate enamel coatings for the conductor ribbons are in the range of 1.2 mils to 2.2 mils per side, with the most preferred being approximately 2 mils per side.

Figure 4:
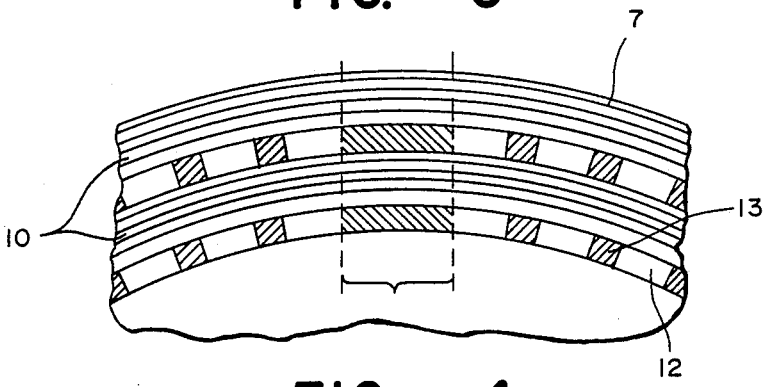
FIG. 4 is a diagrammatic cross sectional view of a portion of the body section with the transformer highlighting the spacers that create cooling ducts.

In a coil section 2–4 inches wide as described above, the conductor bundle edges do not have sufficient area to provide adequate cooling. In such designs, vertical cooling ducts 12 formed in the regions between vertical spacers 13 may be provided as shown in FIGS. 1 and 4 to cool the winding. When needed, cooling ducts may be placed in the end and tap coil sections in the same radial locations as in the body sections.

Figure 5:
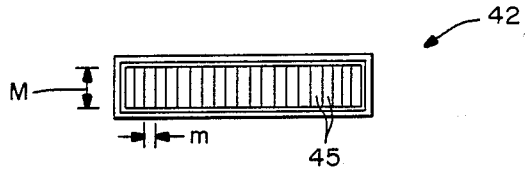
FIG. 5 is a cross sectional view of an end conductor bundle section.
Figure 6:
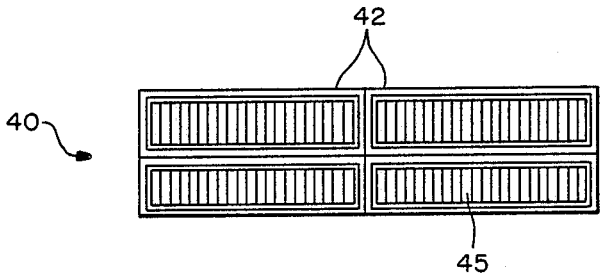
FIG. 6 is a diagrammatic cross sectional view of through two turns of a end section conductor bundle.

In the tap and end sections of the coils which are subject to divergent fields, the eddy current losses are largely determined by the vertical dimension of the individual strands. Referring next to FIGS. 5 and 6, the conductor bundle 40 in these regions may be divided into a pair of side by side bundle sections 42. To minimize the eddy current losses, each bundle section 42 is comprised of a large number of extremely small rectangular conductor strands 45 as shown in FIG. 5. Each conductor strand 45 is enamel coated and will generally be in the range of 60 to 90 mils high and less than 40 mils thick. By way of example, an appropriate thickness would be approximately 30 mils. For the purpose of this description, each of the substantially rectangular strands 45 will be defined as having a major axis and a minor axis. The major axis (M) is defined as the cross sectional height, while the minor axis (m) is defined as the cross sectional width.

The rectangular conductor strands 45 are laid side by side and may be bonded together using a solvent-activated adhesive over the enamel insulation. The bundle section 42 is then taped with an adhesive paper 57 as shown in FIG. 5. Preferably two layers of the adhesive paper 57 will be wrapped about the conductor strands 45 to form a bundle section 42.

The thickness of the strands 45 across the width of the turn largely determines the magnitude of the eddy current losses due to the direction of the magnetic flux. Thus, the thickness of the strands 45 along their minor axis, (i.e., the 30 mils) and not their major axis height will determine the magnitude of the eddy current losses.

Figure 7:
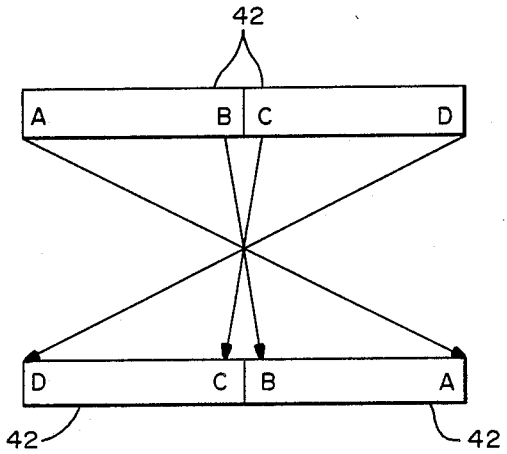
FIG. 7 is a representative transposition pattern for the end section conductor bundle.

To eliminate circulating currents, transpositions may be made as needed. An appropriate transposition pattern is shown in FIG. 7.

To ensure good conductor strength, the conductor bundle sections 42 should not exceed a width of two inches. In a preferred embodiment, the width of the conductor bundles 40 that form the winding in the region of the end and tap sections will be identical to the width of the conductor bundle 7 in the body section of the coil. In the described embodiment, the conductor bundles are between two and four inches wide. In such an embodiment, the conductor bundle 40 in the end and tap regions may be formed of a pair of side by side bundle sections. However, it should be appreciated, that the width of the conductor bundle 40 may be widely varied within the scope of the invention and that when the design of a particular transformer dictates, the conductor bundle 40 may be formed from a single bundle section, or more than two bundle sections.

Finely-stranded conductors formed into bundle sections that are inches wide yet only a small fraction of an inch thick have several advantages in addition to reducing eddy current losses. For example, continuous windings formed in such a manner have the advantage of greatly improving impulse voltage distribution which permits a significant reduction in turn-to-turn, section-to-section and section-to-ground insulation clearances. Further, circulating currents within the winding may be virtually eliminated since the conductor bundle in the end and tap regions may be nearly equivalent to continuously transposed conductors. Additionally, the overall size of the transformer may be reduced significantly since the number of section-to-section ducts may be reduced.

Although only one embodiment of the present invention has been described, it should be understood that the present invention may be embodied in many other specific forms without departing from the spirit or scope of the invention. Particularly, the actual construction of the transformer may be widely varied. For example, the need for cooling ducts and tap connectors will be entirely dependant upon the transformer design requirements. It should also be appreciated that the dimensions of the conductor bundles and bundle sections, as well as the dimensions of its individual conductor strands could be varied beyond the exemplary ranges provided within the scope of the present invention. This is particularly true for the dimensions of the conductor bundle and ribbons within the body section. The transposition scheme may also be widely varied within the scope of the present invention. Therefore, the present examples are to be considered as illustrative and not restrictive, and the invention is not to be limited to the details given herein, but may be modified within the scope of the appended claims.

We claim:

1. A winding for a core-form induction transformer comprising:

a first elongated conductor bundle portion formed from at least one insulated conductor ribbon, and a plurality of second conductor bundle portions each having at least one bundle section formed from a multiplicity of elongated insulated conductor strands arranged in side by side relation, each said conductor strand having a substantially rectangular cross section with a pair of substantially parallel contact surfaces and a minor axis, said minor axis joining said contact surfaces, the thickness of each conductor strand along said minor axis being less than approximately 40 mils, said conductor strands being mounted in side by side relation such that their respective contact surfaces abut, wherein said first and second conductor bundle portions are spirally wound in a multiplicity of turns to form a coil winding, said coil winding including a top end section, a body section and a bottom end section, wherein said body section is wound with said first bundle portion and said top and bottom end sections are wound with said second bundle portions.

2. A winding as recited in claim 1 wherein said first bundle portion is formed of a plurality of rectangular conductor ribbons arranged in side by side relation.

3. A winding as recited in claim 2 wherein each said conductor ribbon is enamel coated to insulate the ribbon.

4. A winding as recited in claim 3 wherein the enamel coating an said conductor ribbons are in the range of 1.2 to 2.2 mils.

5. A winding for a core-form induction transformer as recited in claim 2 further comprising a sheet of adhesive-coated paper for disposition between said body section turns to increase the mechanical strength of the winding.

6. A winding as recited in claim 5 wherein said adhesive paper is in the range of 3 to 7 mils thick.

7. A winding as recited in claim 1 further comprising at least one tap connector wherein said coil winding further includes a tap section in the region adjacent the tap connector, the tap section being wound with one of said second bundle portions.

8. A winding as recited in claim 1 wherein the conductor strands have a width in the range of 60 to 90 mils.

9. A winding for a core-form induction transformer as recited in claim 1 wherein each said conductor strand is coated with enamel to electrically insulate the strands.

10. A winding for a core-form induction transformer as recited in claim 1 wherein the second bundle portions each include a plurality of bundle sections.

11. A winding for a core-form induction transformer comprising:

a body section formed of a first elongated conductor bundle formed from a plurality of insulated body conductor ribbons arranged in side by side relation, wherein the first conductor bundle is spirally wound in a multiplicity of turns to form body section of the winding;

an end section formed of a second elongated conductor bundle having at least one bundle section formed from a multiplicity of elongated insulated end conductor strands arranged in side by side relation, each said end conductor strand having a substantially rectangular cross section with a pair of substantially parallel contact surfaces and a minor axis, said minor axis joining said contact surfaces, the thickness of each end conductor strand along said minor axis being less than approximately 40 mils, said end conductor strands being mounted side by side such that their respective contact surfaces abut, wherein the second conductor bundle is spirally wound in a multiplicity of turns to form a second portion of the coil.

12. A winding as recited in claim 11 wherein the end conductor strands have a width along said major axes in the range of 60 to 90 mils.

13. A winding for a core-form induction transformer as recited in claim 11 further comprising a second end section, said first and second end sections being disposed on opposite sides of said body section.

14. A winding for a core-form induction transformer as recited in claim 13 wherein the transformer further includes at least one tap connection for a deenergized tap changer, the winding further comprising a tap section formed of a third elongated conductor bundle having at least one bundle section formed from a multiplicity of elongated tap conductor strands arranged in side by side relation, each said tap conductor strand having a substantially rectangular cross section with a pair of substantially parallel contact surfaces and a minor axis, said minor axis joining said contact surfaces, the thickness of each tap conductor strand along said minor axis being less than approximately 40 mils, said tap conductor strands being mounted side by side such that their respective contact surfaces abut, wherein the third conductor bundle is spirally would in a multiplicity of turns to form a third portion of the coil.

15. A winding as recited in claim 14 wherein said second and third conductor bundles each have at least two bundle sections.

16. A winding as recited in claim 15 wherein the end conductor strands and the tap conductor strands both have widths in the range of 60 to 90 mils along their respective major axes.

17. A winding for a core-form induction transformer as recited in claim 11 wherein said conductor ribbons are rectangular.

18. A winding for a core-form induction transformer as recited in claim 17 wherein said insulated conductor ribbons are enamel coated.

19. A winding for a core-form induction transformer comprising:

a first elongated conductor bundle portion formed from a plurality of enamel coated conductor ribbon arranged in side by side relation, and a plurality of second conductor bundle portions each having a pair of bundle sections formed from a multiplicity of enamel coated elongated conductor strands arranged in side by side relation, each said conductor strand having a substantially rectangular cross section with a pair of substantially parallel contact surfaces and a minor axis, said minor axis joining said contact surfaces, the thickness of each conductor strand along said minor axis being less than approximately 40 mils, said conductor strands being mounted in side by side relation such that their respective contact surfaces abut, wherein said first and second conductor bundle portions are spirally wound in a multiplicity of turns to form a coil winding, said coil winding including a top end section, a body section and a bottom end section, wherein said body section is wound with said first bundle portion and said top and bottom end sections are wound with said second bundle portion.

* * * * *